US010329710B2

(12) United States Patent
Barnwell

(10) Patent No.: US 10,329,710 B2
(45) Date of Patent: Jun. 25, 2019

(54) IRON CRADLING DEVICE

(71) Applicant: Russell Barnwell, Brentwood, NY (US)

(72) Inventor: Russell Barnwell, Brentwood, NY (US)

( * ) Notice: Subject to any disclaimer, the term of this patent is extended or adjusted under 35 U.S.C. 154(b) by 0 days.

(21) Appl. No.: 15/592,567

(22) Filed: May 11, 2017

(65) Prior Publication Data

US 2018/0327962 A1 Nov. 15, 2018

(51) Int. Cl.
*D06F 81/00* (2006.01)

(52) U.S. Cl.
CPC ..... *D06F 81/003* (2013.01); *D06F 81/00* (2013.01)

(58) Field of Classification Search
CPC ..... D06F 81/00; D06F 81/003; D06F 75/40; D06F 79/02; D06F 79/023; D06F 79/026
USPC ..... D32/71, 73
See application file for complete search history.

(56) References Cited

U.S. PATENT DOCUMENTS 2,866,614 A * 12/1958 Lael ..... D06F 81/003 248/117.7
3,176,947 A * 4/1965 Inverso ..... D06F 79/02 248/117.6
3,215,379 A * 11/1965 Rico ..... D06F 79/02 248/117.2
3,268,192 A 8/1966 Munson
3,913,878 A * 10/1975 Wayne ..... D06F 81/00 248/311.2
3,967,802 A * 7/1976 Lomagno ..... D06F 81/003 248/117.4
4,368,863 A * 1/1983 Gentile ..... D06F 79/02 248/117.7
4,657,213 A * 4/1987 Hartlage ..... D06F 81/003 248/117.7
5,142,802 A 9/1992 Krause
5,926,984 A 7/1999 Zuber
6,068,222 A * 5/2000 Stangeland ..... D06F 79/02 248/117.7
6,375,132 B1 * 4/2002 Tomlinson ..... D06F 81/003 248/117.6
D514,766 S 2/2006 Manfiotto
7,370,446 B2 5/2008 Gross et al.
8,083,079 B2 12/2011 Rosen
8,132,346 B1 3/2012 Cooper et al.
2011/0035974 A1 * 2/2011 Maurer ..... D06F 79/02 38/82

* cited by examiner

*Primary Examiner* — Ismael Izaguirre

(57) ABSTRACT

An iron cradling device for stabilizing an iron on an ironing board includes a first plate and a pair of second plates. The second plates are coupled to and extend perpendicularly from a top of the first plate to define a channel. The channel is complementary to a base of an iron. A plurality of couplers is coupled to the first plate. The couplers are configured to reversibly couple to an ironing board. The channel is configured to insert the base of the iron to stabilize the iron on the first plate. The couplers are configured to couple to the ironing board to couple the first plate to the ironing board.

18 Claims, 3 Drawing Sheets

IRON CRADLING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to cradling devices and more particularly pertains to a new cradling device for stabilizing an iron on an ironing board.

BRIEF SUMMARY OF THE INVENTION

An embodiment of the disclosure meets the needs presented above by generally comprising a first plate and a pair of second plates. The second plates are coupled to and extend perpendicularly from a top of the first plate to define a channel. The channel is complementary to a base of an iron. A plurality of couplers is coupled to the first plate. The couplers are configured to reversibly couple to an ironing board. The channel is configured to insert the base of the iron to stabilize the iron on the first plate. The couplers are configured to couple to the ironing board to couple the first plate to the ironing board.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
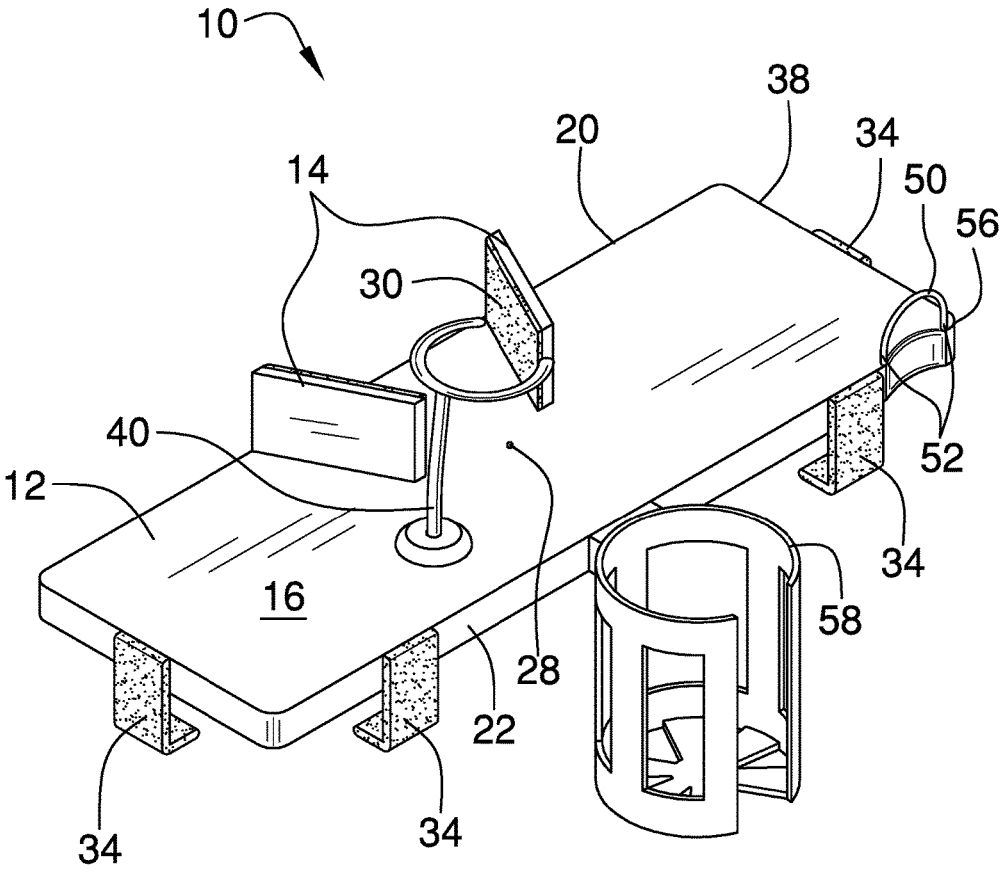
FIG. 1 is an isometric perspective view of an iron cradling device according to an embodiment of the disclosure.
Figure 2:
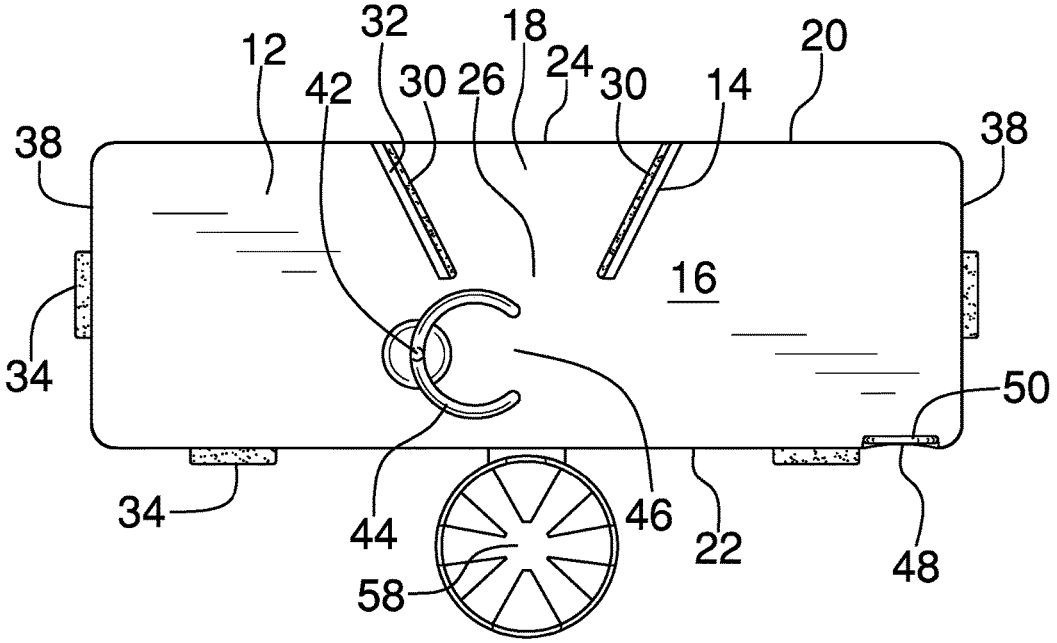
FIG. 2 is a top view of an embodiment of the disclosure.
Figure 3:
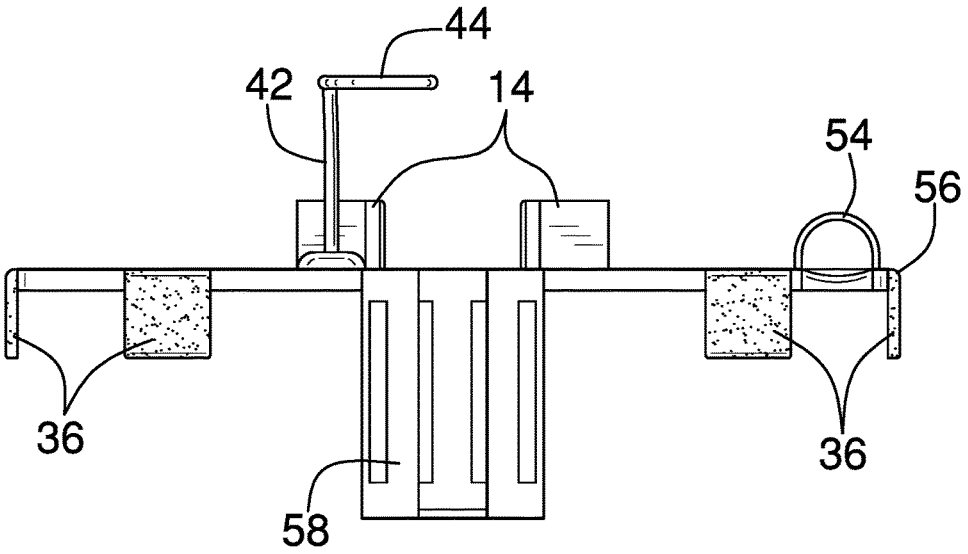
FIG. 3 is a side view of an embodiment of the disclosure.
Figure 4:
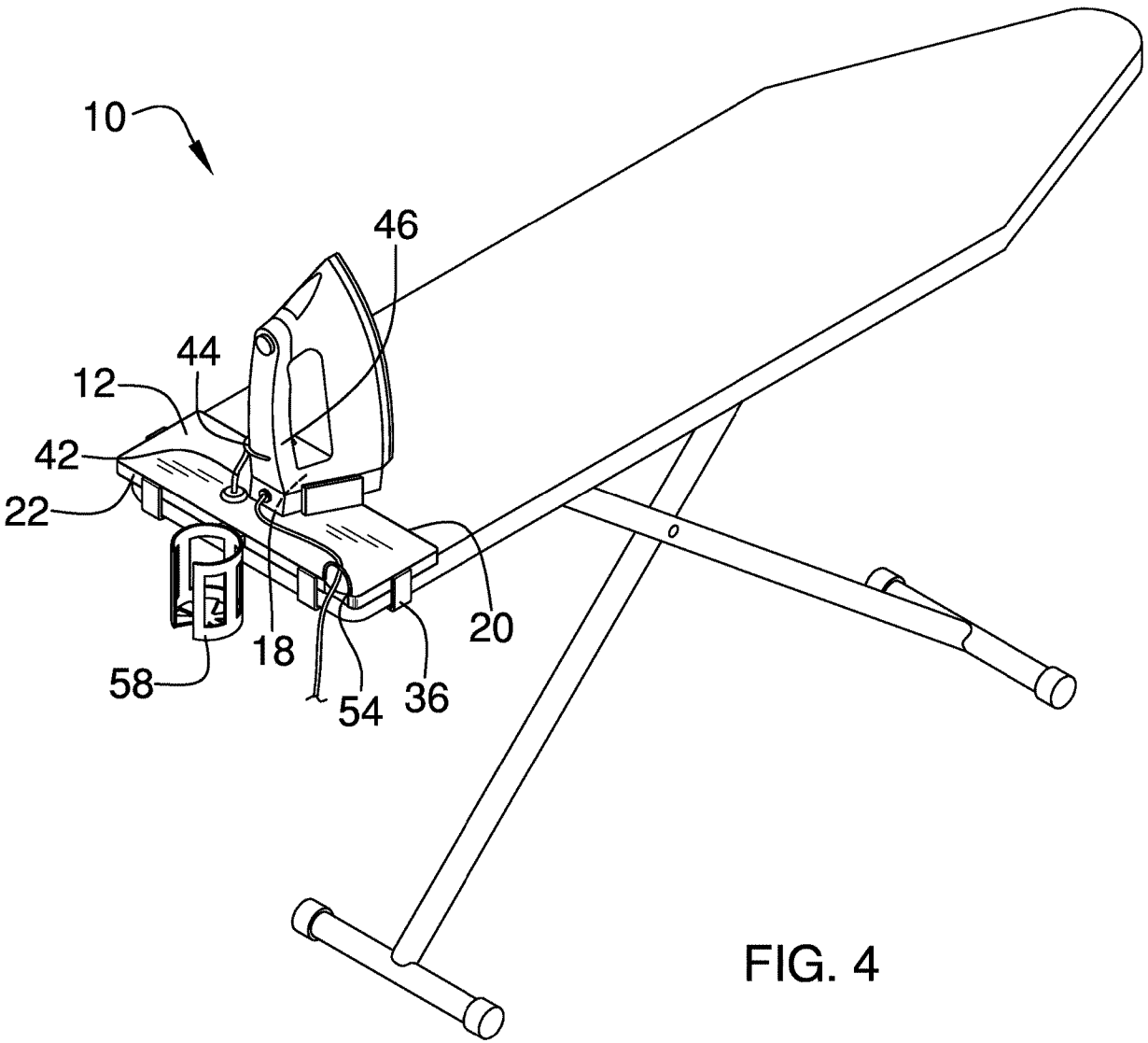
FIG. 4 is an in-use view of an embodiment of the disclosure.

With reference now to the drawings, and in particular to FIGS. 1 through 4 thereof, a new cradling device embodying the principles and concepts of an embodiment of the disclosure and generally designated by the reference numeral 10 will be described.

As best illustrated in FIGS. 1 through 4, the iron cradling device 10 generally comprises a first plate 12 and a pair of second plates 14. In one embodiment, the first plate 12 is substantially rectangularly shaped. In another embodiment, the first plate 12 is dimensioned substantially complementarily to a flat end of an ironing board.

The pair of second plates 14 is coupled to and extends perpendicularly from a top 16 of the first plate 12 to define a channel 18. The channel 18 is complementary to a base of an iron. The channel 18 is configured to insert the base of the iron to stabilize the iron on the first plate 12. In one embodiment, the second plates 14 extend transversely from a first edge 20 toward a second edge 22 of the first plate 12. A wide end 24 of the channel 18 is positioned adjacent to the first edge 20 and a narrow end 26 of the channel 18 is positioned proximate to a midpoint 28 of the first plate 12. In another embodiment, the channel 18 is centrally positioned on the first edge 20. In yet another embodiment, the second plates 14 are substantially rectangularly shaped.

Each of a pair of pads 30 is coupled to an inside face 32 of a respective second plate 14. The pads 30 are shaped complementarily to the second plates 14. The pads 30 are configured to abut the iron that is positioned in the channel 18. In one embodiment, the pads 30 comprise rubber.

A plurality of couplers 34 is coupled to the first plate 12. The couplers 34 are configured to couple to the ironing board to couple the first plate 12 to the ironing board. In one embodiment, each coupler 34 comprises a bracket 36. The brackets 36 are resilient and L-shaped. The brackets 36 are configured to be deformed to insert the ironing board. The brackets 36 are positioned to rebound to couple the first plate 12 to the ironing board.

In another embodiment, the brackets 36 comprise rubber. In yet another embodiment, the plurality of couplers 34 comprises two brackets 36 that are positioned on the second edge 22. The brackets 36 are configured to couple to the flat end of the ironing board to couple the first plate 12 to the ironing board with the brackets 36 positioned proximate to corners of the ironing board. In still yet another embodiment, the plurality of couplers 34 comprises two brackets 36 that are positioned singly on opposing ends 38 of the first plate 12. Each bracket 36 is positioned substantially equally distant from the first edge 20 and the second edge 22. The brackets 36 are configured to couple to opposing sides of the ironing board to couple the first plate 12 to the ironing board.

A fastener 40 is coupled to the top 16 of the first plate 12 proximate to the narrow end 26 of the channel 18. The fastener 40 is configured to selectively couple to a handle of the iron. The fastener 40 is configured to couple to the handle of the iron to retain the iron within the channel 18.

In one embodiment, the fastener 40 comprises a rod 42 and a ring 44. The rod 42 is coupled to and extends from the first plate 12. The rod 42 is selectively deformable. The ring 44 is coupled to the rod 42 distal from the first plate 12. The ring 44 is open to define a slot 46. The rod 42 is configured to be bent so that the slot 46 is configured to insert the handle of the iron into the ring 44 to retain the iron within the channel 18.

In one embodiment, the device 10 comprises a cutout 48 and a wire 50. The cutout 48 is positioned in the first plate 12. The wire 50 has opposing endpoints 52. Each opposing endpoint 52 is coupled to the first plate 12 adjacent to the cutout 48 to define a loop 54. The loop 54 is configured to insert a power cord of the iron to guide the power cord. In another embodiment, the cutout 48 is positioned in the second edge 22 proximate to a respective corner 56 of the first plate 12. In yet another embodiment, the cutout 48 is arcuate.

In one embodiment, the device 10 comprises a holder 58. The holder 58 is coupled to the second edge 22 of the first plate 12. The holder 58 is complementary to a cup. The holder 58 is configured to insert the cup to couple the cup to the first plate 12. In another embodiment, the holder 58 is centrally positioned on the second edge 22.

In use, the brackets 36 that are positioned on the second edge 22 and the opposing ends 38 of the first plate 12 are configured to be deformed to insert the ironing board. The brackets 36 are positioned to rebound to couple the first plate 12 to the ironing board. The second plates 14 are positioned on the first plate 12 to define the channel 18. The channel 18 is configured to insert the base of the iron to stabilize the iron on the first plate 12. The pads 30 that are positioned on the second plates 14 are configured to abut the iron that is positioned in the channel 18. The rod 42 is configured to be bent so that the slot 46 is configured to insert the handle of the iron into the ring 44 to retain the iron within the channel 18. The wire 50 that is positioned on the first plate 12 defines the loop 54. The loop 54 is configured to insert the power cord of the iron to guide the power cord.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An iron cradling device comprising:

a first plate;

a pair of second plates coupled to and extending perpendicularly from a top of said first plate defining a channel complementary to a base of an iron;

a plurality of couplers coupled to said first plate, said couplers being configured for reversibly coupling to an ironing board;

wherein said second plates are positioned on said first plate such that said channel is configured for inserting the base of the iron for stabilizing the iron on said first plate, wherein said couplers are positioned on said first plate such that said couplers are configured for coupling to the ironing board for coupling the said first plate to the ironing board;

said second plates extending transversely from a first edge toward a second edge of said first plate such that a wide end of said channel is positioned adjacent to said first edge and a narrow end of said channel is positioned proximate to a midpoint of said first plate; and a fastener coupled to said top of said first plate proximate to said narrow end of said channel, said fastener being configured for selectively coupling to a handle of the iron, wherein said fastener is positioned on said first plate such that said fastener is configured for coupling to the handle of the iron for retaining the iron within said channel.

2. The device of claim 1, further including said first plate being substantially rectangularly shaped.

3. The device of claim 2, further including said first plate being dimensioned substantially complementarily to a flat end of an ironing board.

4. The device of claim 1, further including said channel being centrally positioned on said first edge.

5. The device of claim 1, further including said second plates being substantially rectangularly shaped.

6. The device of claim 1, further including a pair of pads, said pads being shaped complementarily to said second plates, each said pad being coupled to an inside face of a respective said second plate, wherein said pads are positioned on said second plates such that said pads are configured for abutting the iron positioned in said channel.

7. The device of claim 6, further including said pads comprising rubber.

8. The device of claim 1, further including each said coupler comprising a bracket, said brackets being resilient, said brackets being L-shaped, wherein said brackets are positioned on said first plate such that said brackets are configured for deforming for inserting the ironing board and for rebounding for coupling said first plate to the ironing board.

9. The device of claim 8, further including said brackets comprising rubber.

10. The device of claim 8, further comprising:

said first plate having a first edge and a second edge; and said plurality of couplers comprising two said brackets positioned on said second edge, wherein said brackets are positioned on said first plate such that said brackets are configured for coupling to the flat end of the ironing board for coupling the said first plate to the ironing board with said brackets being positioned proximate to corners of the ironing board.

11. The device of claim 8, further including said plurality of couplers comprising two said brackets positioned singly on opposing ends of said first plate, each said bracket being positioned substantially equally distant from said first edge and said second edge, wherein said brackets are positioned on said first plate such that said brackets are configured for coupling to opposing sides of the ironing board for coupling the said first plate to the ironing board.

12. The device of claim 1, further including said fastener comprising a rod and a ring, said rod being coupled to and extending from said first plate, said rod being selectively deformable, said ring being coupled to said rod distal from said first plate, said ring being open defining a slot, wherein said rod is positioned on said first plate such that said rod is configured for bending such that said slot is configured for inserting the handle of the iron into said ring for retaining the iron within said channel.

13. The device of claim 1, further comprising:

a cutout positioned in said first plate;

a wire having opposing endpoints, each said opposing endpoint being coupled to said first plate adjacent to said cutout defining a loop; and wherein said wire is positioned on said first plate such that said loop is configured for inserting a power cord of the iron for guiding the power cord.

14. The device of claim 13, further including said cutout being positioned in said second edge proximate to a respective corner of said first plate.

15. The device of claim 13, further including said cutout being arcuate.

16. An iron cradling device comprising:

a first plate;

a pair of second plates coupled to and extending perpendicularly from a top of said first plate defining a channel complementary to a base of an iron;

a plurality of couplers coupled to said first plate, said couplers being configured for reversibly coupling to an ironing board; and wherein said second plates are positioned on said first plate such that said channel is configured for inserting the base of the iron for stabilizing the iron on said first plate, wherein said couplers are positioned on said first plate such that said couplers are configured for coupling to the ironing board for coupling the said first plate to the ironing board;

said second plates extending transversely from a first edge toward a second edge of said first plate such that a wide end of said channel is positioned adjacent to said first edge and a narrow end of said channel is positioned proximate to a midpoint of said first plate; and a holder coupled to said second edge of said first plate, said holder being complementary to a cup, wherein said holder is positioned on said first plate such that said holder is configured for inserting the cup for coupling the cup to said first plate.

17. The device of claim 16, further including said holder being centrally positioned on said second edge.

18. An iron cradling device comprising:

a first plate, said first plate being substantially rectangularly shaped, said first plate being dimensioned substantially complementarily to a flat end of an ironing board;

a pair of second plates coupled to and extending perpendicularly from a top of said first plate defining a channel complementary to a base of an iron, wherein said second plates are positioned on said first plate such that said channel is configured for inserting the base of the iron for stabilizing the iron on said first plate, said second plates extending transversely from a first edge toward a second edge of said first plate such that a wide end of said channel is positioned adjacent to said first edge and a narrow end of said channel is positioned proximate to a midpoint of said first plate, said channel being centrally positioned on said first edge, said second plates being substantially rectangularly shaped;

a pair of pads, said pads being shaped complementarily to said second plates, each said pad being coupled to an inside face of a respective said second plate, wherein said pads are positioned on said second plates such that said pads are configured for abutting the iron positioned in said channel, said pads comprising rubber;

a plurality of couplers coupled to said first plate, said couplers being configured for reversibly coupling to an ironing board, wherein said couplers are positioned on said first plate such that said couplers are configured for coupling to the ironing board for coupling the said first plate to the ironing board, each said coupler comprising a bracket, said brackets being resilient, said brackets being L-shaped, wherein said brackets are positioned on said first plate such that said brackets are configured for deforming for inserting the ironing board and for rebounding for coupling said first plate to the ironing board, said brackets comprising rubber, said plurality of couplers comprising two said brackets positioned on said second edge, wherein said brackets are positioned on said first plate such that said brackets are configured for coupling to the flat end of the ironing board for coupling the said first plate to the ironing board with said brackets being positioned proximate to corners of the ironing board, said plurality of couplers comprising two said brackets positioned singly on opposing ends of said first plate, each said bracket being positioned substantially equally distant from said first edge and said second edge, wherein said brackets are positioned on said first plate such that said brackets are configured for coupling to opposing sides of the ironing board for coupling the said first plate to the ironing board;

a fastener coupled to said top of said first plate proximate to said narrow end of said channel, said fastener being configured for selectively coupling to a handle of the iron, wherein said fastener is positioned on said first plate such that said fastener is configured for coupling to the handle of the iron for retaining the iron within said channel, said fastener comprising a rod and a ring, said rod being coupled to and extending from said first plate, said rod being selectively deformable, said ring being coupled to said rod distal from said first plate, said ring being open defining a slot, wherein said rod is positioned on said first plate such that said rod is configured for bending such that said slot is configured for inserting the handle of the iron into said ring for retaining the iron within said channel;

a cutout positioned in said first plate, said cutout being positioned in said second edge proximate to a respective corner of said first plate, said cutout being arcuate;

a wire having opposing endpoints, each said opposing endpoint being coupled to said first plate adjacent to said cutout defining a loop, wherein said wire is positioned on said first plate such that said loop is configured for inserting a power cord of the iron for guiding the power cord;

a holder coupled to said second edge of said first plate, said holder being complementary to a cup, wherein said holder is positioned on said first plate such that said holder is configured for inserting the cup for coupling the cup to said first plate, said holder being centrally positioned on said second edge; and wherein said brackets are positioned on said second edge and said opposing ends of said first plate such that said brackets are configured for deforming for inserting the ironing board and for rebounding for coupling said first plate to the ironing board, wherein said second plates are positioned on said first plate such that said channel is configured for inserting the base of the iron for stabilizing the iron on said first plate, wherein said pads are positioned on said second plates such that said pads are configured for abutting the iron positioned in said channel, wherein said rod is positioned on said first plate such that said rod is configured for bending such that said slot is configured for inserting the handle of the iron for retaining the iron within said channel, wherein said wire is positioned on said first plate such that said loop is configured for inserting the power cord of the iron for guiding the power cord.

* * * * *